US006826383B2

(12) United States Patent
Yano

(10) Patent No.: US 6,826,383 B2
(45) Date of Patent: Nov. 30, 2004

(54) SHEET SIZE DETECTION APPARATUS AND IMAGE FORMING APPARATUS

(75) Inventor: Takashi Yano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/653,269

(22) Filed: Sep. 3, 2003

(65) Prior Publication Data

US 2004/0047663 A1 Mar. 11, 2004

(30) Foreign Application Priority Data

Sep. 9, 2002 (JP) ..... 2002-263252

(51) Int. Cl.[7] ..... G03G 21/00

(52) U.S. Cl. ..... 399/389; 400/624; 400/706.1; 400/708; 271/144; 271/171

(58) Field of Search ..... 400/624, 625, 400/703, 706.1, 708; 399/388, 389, 363; 116/307; 271/3.15, 9.01, 144, 171

(56) References Cited

U.S. PATENT DOCUMENTS 4,697,803 A * 10/1987 Kan et al. ..... 271/127
5,121,169 A * 6/1992 Kawabata ..... 399/389
5,130,757 A * 7/1992 Ito ..... 399/14
5,135,320 A * 8/1992 Sugino ..... 400/283
5,839,047 A * 11/1998 Hirabayashi et al. ..... 399/389
6,000,871 A * 12/1999 Fisher, Sr. ..... 400/706
6,116,590 A * 9/2000 Yokoyama et al. ..... 271/171
6,260,840 B1 7/2001 Suga et al. ..... 271/10.12
6,467,767 B2 10/2002 Yano ..... 271/122
6,676,316 B2 * 1/2004 Mindler et al. ..... 400/624

* cited by examiner

*Primary Examiner*—Daniel J. Colilla
*Assistant Examiner*—Dave A. Ghatt
(74) *Attorney, Agent, or Firm*—Fitzpatrick, Cella, Harper & Scinto

(57) ABSTRACT

A sheet size detection apparatus including, a sheet stacking device on which sheets are stacked and which can be loaded into and unloaded from a loading portion, a sheet size selection member provided on the sheet stacking device, a position of the sheet size selection member being changeable in accordance with a size of stacked sheets, a sheet size detection device provided on the loading portion for detecting the sheet size based on a relative positional relationship with the sheet size selection member, a locking member that can lock the sheet size selection member, and an unlock member for releasing a locking operation of the locking member.

10 Claims, 13 Drawing Sheets

SHEET SIZE DETECTION APPARATUS AND IMAGE FORMING APPARATUS

BACKGROUND OF THE INVENTION

1. Field of the Invention

The present invention relates to a sheet size detection apparatus for detecting the size of a sheet and an image forming apparatus, such as a copying machine, a facsimile machine, a printer or a multifunction machine serving as a combination of those machines, for forming an image on a sheet based on sheet size information obtained by the sheet size detection apparatus.

2. Description of the Related Art

Generally, an image forming apparatus forms an image on a sheet in accordance with the sheet size, and therefore the apparatus main body is designed to recognize the size of a sheet(s) that is set in a sheet feed tray by a user. Some high grade image forming apparatus with which restriction on cost is light are provided with a mechanism that is interlocked with the position of a regulation member for regulating the width direction or the length direction of the sheets on a sheet feed tray to detect the sheet size automatically. However, such a mechanism requires a complex link mechanism or the like, which sometimes causes an increase in the cost. On this account, some common image forming apparatus is provided with a sheet size selection member with which the sheet size setting is selected-by a user manually.

Conventional common sheet size detection apparatus are shown in FIGS. 12 and 13. FIG. 12 is a perspective view showing a sheet feed tray 130 provided with a conventional sheet size detection apparatus 102 using a slide type sheet size selection member 151.

The sheet size selection member 151 is provided on a front edge portion 130*e* of the sheet feed tray and adapted to be slidable in the direction along the front edge portion 130*e* shown by the arrow A (i.e. in the horizontal direction). On the backside wall of the sheet size selection member 151, there is provided a predetermined pattern including projections and depressions (not shown).

The sheet size detection apparatus 102 is constructed in such a way that upon setting sheets on the sheet feed tray 130, the user would cause the sheet size selection member 151 to slide in the directions indicated by the double-headed arrow A to a position corresponding to the size of the set sheets to set the size. This is done by adjusting a size pointer 152 of the sheet size selection member 151 with an appropriate position on a sheet size scale provided on the front edge portion 130*e* of the sheet feed tray 130.

When the user pushes the sheet feed tray 130 in the sheet feeding cassette attaching (or loading) direction indicated by the arrow X to bring it into the main body 101 of the image forming apparatus 100, the sheet size detection apparatus 102 reads the pattern on the sheet size selection member 151 by means of a size detection sensor 150 provided on the apparatus main body 101 to detect the sheet size so that the apparatus main body would recognize the sheet size.

FIG. 13 is a perspective view showing a sheet feed tray 230 provided with a conventional sheet size detection apparatus 202 using a rotary type sheet size selection member 261.

The sheet size selection member 261 is provided on a front edge portion 230*e* of the sheet feed tray 230 and adapted to be rotatable. On the cylinder side wall 261*b* of the sheet size selection member 261, there is provided a predetermined pattern including projections and depressions in a manner similar to the above-described slide type sheet size selection member 161.

The sheet size detection apparatus 202 is constructed in such a way that upon setting sheets on the sheet feed tray 230, the user would rotate the sheet size selection member 261 in the direction indicated by the arrow B to cause a sheet size name selected from a sheet size scale provided on the top surface of the sheet size selection member 261 to be aligned with the position of a size pointer 264. When the user pushes the sheet feed tray 230 in the sheet feeding cassette attaching direction indicated by the arrow X to bring it into the main body 201 of the image forming apparatus 200, the sheet size detection apparatus 202 reads the pattern on the sheet size selection member 261 by a size detection sensor 260 provided on the apparatus main body 201 to detect the sheet size so that the apparatus main body would recognize the sheet size.

The conventional sheet size detection apparatus 102 and 202 provided with the sheet size selection member 151 and 261 having the above-described structures have advantages that setting of the sheet size can be performed with a simple structure. However, they suffer from the following problems.

Set positions of the sheet size selection member 151 and 261 are easy to be displaced inadvertently. From the standpoint of improving operability, it is preferable to provide the sheet size selection member 151 or 261 on the front edge portion 130*e* or 230*e* of the sheet feed tray 130 or 230. However, with that layout, when the user sets sheets on the sheet feed tray 130 or 230, it is likely that the user's hands or the sheets touch the sheet size selection member 151 or 261. Consequently, the set position of the sheet size selection member 151 or 261 is sometimes changed upon setting of the sheets, so that the size detection sensor detects a different sheet size.

Furthermore, the image forming apparatus provided with such a sheet size detection apparatus sometimes recognizes the sheet size erroneously. This may cause malfunction of the apparatus or a jam.

The sheet size selection members 151 and 261 are sometimes set to a position displaced from the position to be set to only a small extent. In that case, it is difficult for the user to find the displacement. In aid of user's operation for positioning the size selection member, the sheet size selection member is generally designed to generate click feeling at predetermined set positions as the sheet size selection member is moved. However, it is not so easy for the user to set the sheet size selection member 151 or 261 to a predetermined position based only on the click feeling.

As per the above, even if the user believes that he or she has set the sheet size correctly, the sheet size may be erroneously set in reality. Furthermore, in the case that the position of the sheet size selection member 151 or 261 is displaced only to a small extent, it is difficult for the user to recognize it visually. Consequently, when the image forming apparatus is in trouble, it will require significant labor and take significant time to find the cause of the trouble.

SUMMARY OF THE INVENTION

An object of the present invention is to provide a sheet size detection apparatus that can prevent inadvertent operation mistakes upon sheet loading, enhance visibility and prevent it from being neglected to be operated.

Another object of the present invention is to provide an image forming apparatus equipped with the above-mentioned sheet size detection apparatus with which the possibility of an operation mistake or a sheet jam is low.

A sheet size detection apparatus according to the present invention comprises:

- sheet stacking means on which sheets are stacked and which can be loaded into and unloaded from a loading portion;
- a sheet size selection member provided on the sheet stacking means, a position of the sheet size selection member being changeable in accordance with a size of stacked sheets;
- sheet size detection means provided on the loading portion to detect the sheet size based on a relative positional relationship with the sheet size selection member;
- locking means that can lock the sheet size selection member; and
- unlock means for releasing a locking operation of the locking means.

Furthermore, a sheet size detection apparatus according to the present invention comprises:

- a sheet feed tray detachably provided on an apparatus main body and having an inner plate on which sheets are to be stacked;
- a sheet size selector slidably provided on the sheet feed tray and to be set at a position corresponding to a size of the sheets by adjusting a size pointer to a sheet size scale on the apparatus main body;
- a size detection sensor provided on the apparatus main body and having a plurality of switches that are to be turned on/off by a portion including projections and depressions provided on the sheet size selector when the sheet feed tray is attached to the apparatus main body;
- a plurality of recessed portions formed on the sheet feed tray;
- a projection formed on the sheet size selector and adapted to engage with either one of the plurality of recessed portions; and
- an unlock lever including the projection on the sheet size selector, the unlock lever being capable of moving the projection away from the recessed portions formed on the sheet feed tray.

DESCRIPTION OF THE PREFERRED EMBODIMENTS

In the following, sheet size detection apparatus as embodiments of the present invention and a printer as an image forming apparatus equipped with the sheet size detection apparatus will be described in its body.

The sheet size detection apparatus is adapted to be provided not only in a printer but also in a copying machine, a facsimile machine or a multifunction machine serving as a combination of those machines.

Furthermore, the sheet size detection apparatus is so adapted that can be provided and used not only in an image forming apparatus but also in the main body of another type of apparatus that handles sheets such as a sheet stapling apparatus (not shown) for stapling a stack of sheets at a prescribed position in accordance with the sheet size or a punching apparatus for punching sheets at a prescribed position in accordance with the sheet size.

Structure of Printer

Figure 1:
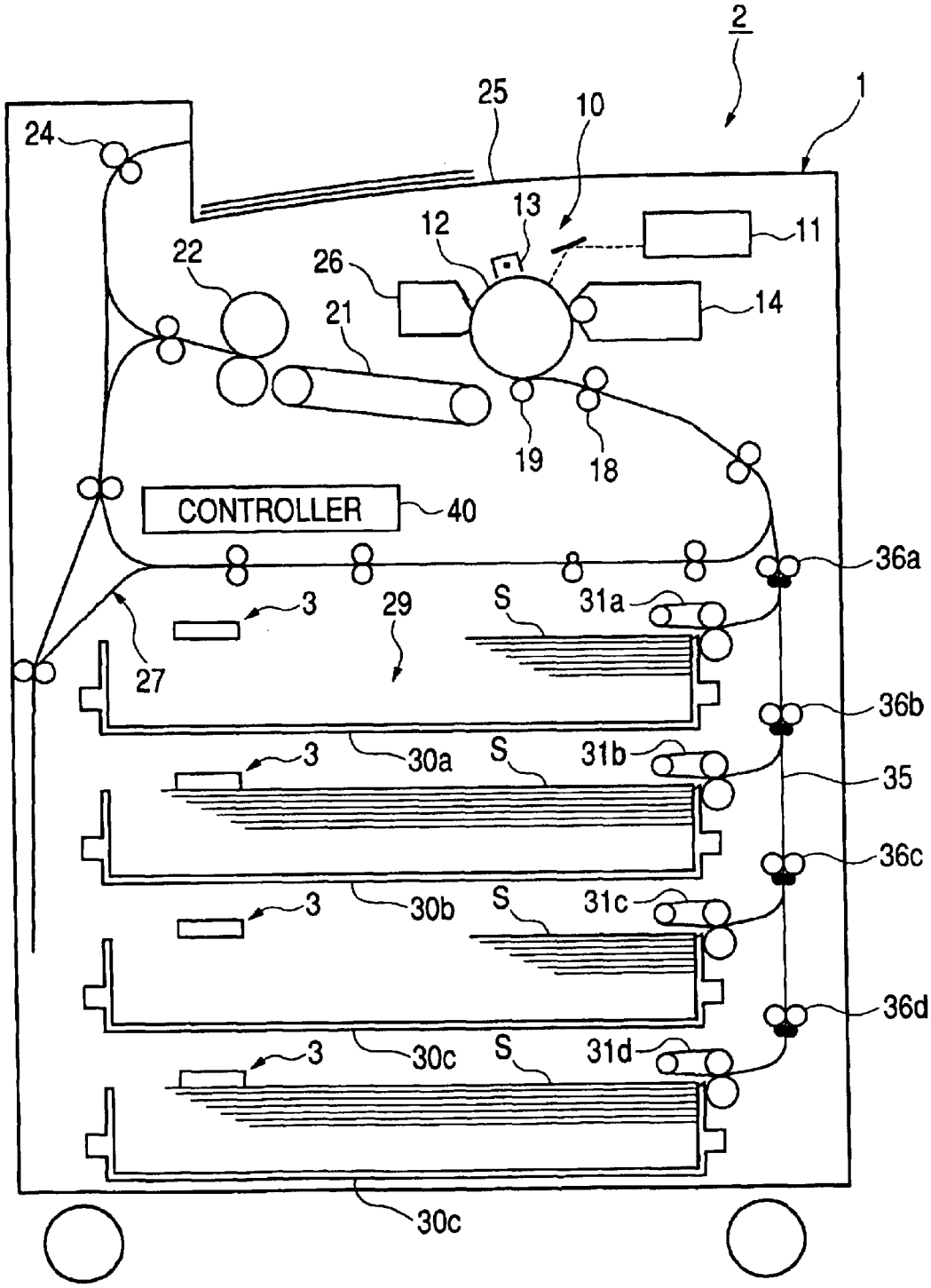
FIG. 1 is a cross sectional front view showing a printer as an example of an image forming apparatus equipped with a sheet size detection apparatus according to a first embodiment.

FIG. 1 is a cross sectional front view of a printer. While the printer shown in FIG. 1 is equipped with a sheet size detection apparatus 3 according to a first embodiment, the printer is so adapted that it can be equipped with a sheet size detection apparatus 4 or 5 according to the second or third embodiment or other sheet size detection apparatus according to other embodiment, which are not shown in the drawings.

In the upper part of the main body 1 of the printer 2, there is provided a laser scanner 11 for drawing an image on a photosensitive drum 12. Print data transmitted from an external device such as a personal computer is received by a controller 40 that controls the main body 1 of the printer 2 and output to the laser scanner 11 as drawing image data. In connection with this, the printer may be provided with an image reading apparatus (not shown) in the upper part of the main body 1 so that read data from the image reading apparatus might be output to the laser scanner 11.

A sheet feeding part 29 is disposed at the most upstream position with respect to the sheet-conveying path. In the printer 2 of this embodiment, the sheet feeding part 29 is provided in the lower part of the apparatus main body 1. The sheet feeding part 29 is composed of sheet feed trays 30*a*, 30*b*, 30*c* and 30*d* and sheet feeding units 31*a*, 31*b*, 31*c* and 31*d* for separately feeding sheets accommodated in the sheet feed trays. When the sheet feed trays 30*a*, 30*b*, 30*c* and 30*d* are referred to collectively, reference numeral 30 will be used hereinafter.

A sheet fed from the sheet feed tray 30 by the sheet feeding unit 31 is conveyed to the downstream by conveying rollers 36*a*, 36*b*, 36*c* and 36*d* provided at positions opposed to the sheet feed tray. At the most downstream position of the vertical conveying path 35, there is provided paired registration rollers 18. The paired registration rollers 18 once receive the sheet and perform a final correction of the inclination of the sheet, and thereafter deliver the sheet to the nip between the photosensitive drum 12 and the transfer roller 19 in conformity with the image drawing position in an image forming portion 10.

The image forming means in the form of, for example, the image forming portion 10 is provided with the photosensitive drum 12, an electrostatic charging device 13 for uniformly charging the surface of the photosensitive drum 12, a developing device 14 for developing an electrostatic latent image formed by drawing of a light figure by the laser scanner 11 on the surface of the photosensitive drum 12 that has been charged by the electrostatic charging device 13 into a toner image to be transferred to a sheet S, the transfer roller 19 for transferring the toner image developed on the surface of the photosensitive drum 12 onto the sheet S and a cleaner 26 for removing residual toner remaining on the photosensitive drum 12 after the transferring of the toner image etc.

In the downstream of the image forming apparatus 10, there is provided a conveying portion 21 for conveying the sheet S on which the toner image has been transferred and a fixing device 22 for fixing the toner image on the sheet S conveyed by the conveying portion 21 as a permanent image. Furthermore, in the downstream of the fixing device 22, there is provided discharge rollers 24 for discharging the sheet S, on which the toner image has been fixed by the fixing device 22, from the printer body 1. On the top of the printer body 1, there is provided a discharged sheet stacking tray for receiving the sheet S discharged by the discharge rollers 24.

In addition, in the downstream of the fixing device 22, there is provided a front and back surfaces reversing conveying apparatus 27 for reversing, in the case that an image is to be formed on the other side of the sheet, the front surface and the back surface of the sheet, on one surface of which an image has been formed, and delivering the sheet to the paired registration rollers 18 and the photosensitive drum 12 again.

Operation of Printer

The controller 40 receives print data transmitted from an external device such as a personal computer and outputs it to the laser scanner as drawing image data. On the other hand, the electrostatic charging device 13 charges the surface of the photosensitive drum 12 uniformly in advance. The laser scanner 11 irradiates the surface of the photosensitive drum 12 that has been uniformly charged with laser light to draw a light figure on the photosensitive drum 12. Thus, an electrostatic latent image is formed on the photosensitive drum 12. The electrostatic latent image is developed to become a toner image.

The sheet feeding portion 29 delivers a sheet to the paired registration rollers 18. The paired registration rollers 18 correct inclination of the sheet and convey it into the nip between the photosensitive drum 12 and the transfer roller 19. The transfer roller 19 transfers the toner image on the photosensitive drum 12 onto the sheet S. The conveying portion 21 conveys the sheet S on which the toner image has been transferred to the fixing device 22. The fixing device 22 fixes the toner image on the sheet S as a permanent image. At the last, the discharge rollers 24 discharge the sheet S onto the discharged sheet stacking tray 25.

In the case that images are to be formed on both sides of the sheet, the front and back surfaces reversing conveying apparatus 27 reverses the front surface and the back surface of the sheet and delivers it to the photosensitive drum 12 again. The transfer roller 19 transfers a toner image on the photosensitive drum 12 onto the other side surface of the sheet. The fixing device fixes the toner image on the sheet. At the last, the discharge rollers 24 discharge the sheet on both side surfaces of which images have been formed onto the discharged sheet stacking tray 25.

Sheet Size Detection Apparatus According to First Embodiment

The sheet size detection apparatus according to the first embodiment will be described with reference to FIGS. 2 to 5.

Figure 2:
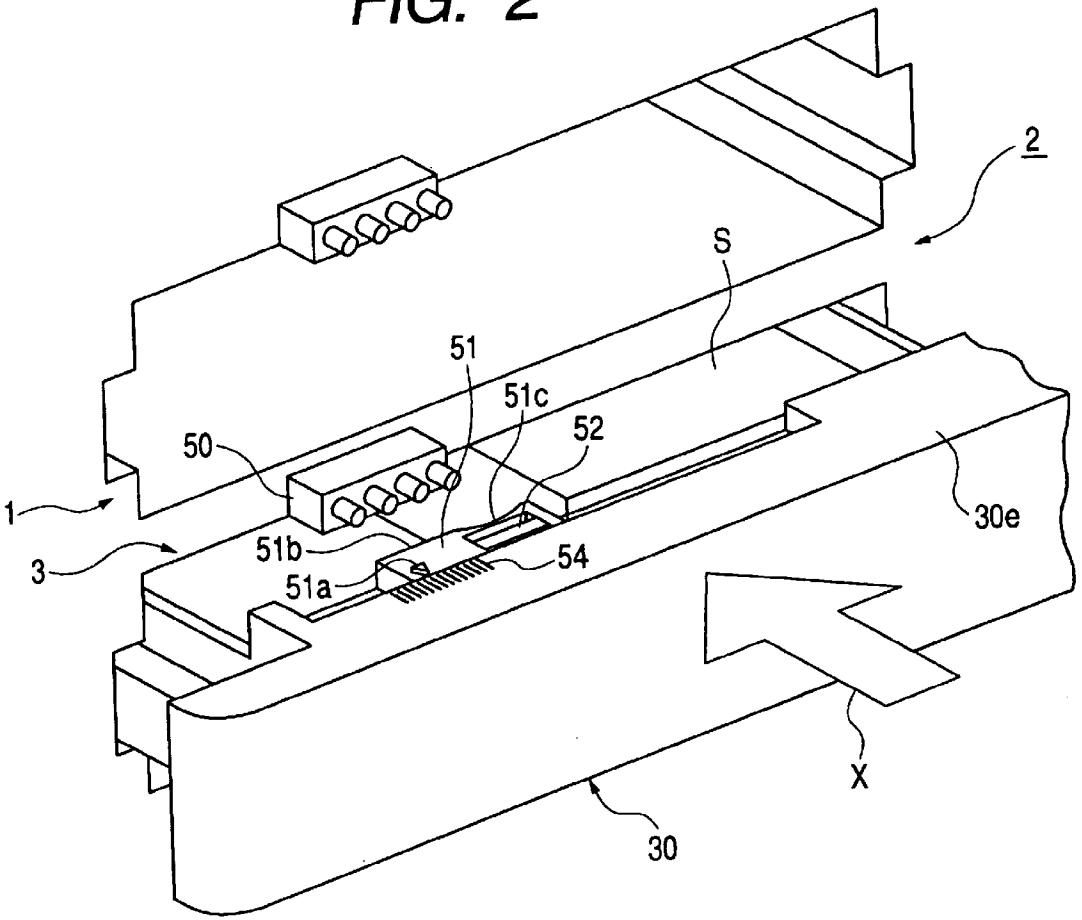
FIG. 2 is a partial perspective view showing the sheet size detection apparatus according to the first embodiment.

FIG. 2 is a perspective view showing a sheet feed tray 30 equipped with a sheet size detection apparatus 3 according to the first embodiment that uses a slide type sheet size selection member 51.

Sheet stacking means, in the form of, for example, the sheet feed tray 30, on which sheets are placed is constructed in such a way that it can be loaded into and unloaded from, for example, the apparatus main body 1 serving as a loading portion of the image forming apparatus 2. In FIG. 2, the sheet feed tray 30 is depicted in the state drawn out from the apparatus main body 1.

On the front edge portion 30*e* of the sheet feed tray 30, there is provided a sheet size selection member in the form of, for example, a sheet size selector 51. The sheet size selector 51 is provided on the front edge portion 30*e* in such a way as to be slidable in the direction indicated by the arrow C along a lock groove 53.

The sheet size detection apparatus 3 according to this embodiment is constructed in such a way that setting of the sheet size is performed by a user by aligning a size pointer 51*a* provided on the sheet size selector 51 with a certain position on a sheet size scale 54 printed on the sheet feed tray 30. In connection with this, a click mechanism is provided between the sheet size selector 51 and the sheet feed tray 30. The click mechanism is for enabling the user to confirm, by a click feeling, that the sheet size selector 51 has moved to a correct set position during the sliding movement of the sheet size selector 51. This mechanism itself is not shown in the drawing, since it is not a major feature of this embodiment.

On the other hand, a size detection sensor 50 comprising four juxtaposed switches is disposed at a position to be opposed to the sheet size selector 51 when the sheet feed tray 30 is attached to the apparatus main body 1 of the printer 2 and pushed in the direction indicated by the arrow X in FIG. 2. On the side 51*b* of the sheet size selector 51 that is to be opposed to the size detection sensor, a detected portion 51*d* engraved with a predetermined pattern including projections and depressions is formed. The position of the projections and depressions of the detected portion 51*d* relative to the sheet size detection means in the form of, for example, the size detection sensor 50 varies depending on the slide position of the sheet size selector 51. Thus, the relationship between the position of the projections and depressions and the four juxtaposed switches of the size detection sensor 50 varies, so that switches to be operated change. The size detection sensor 50 according to this embodiment is also used for detecting "the state that the cassette is drawn out" by the state in which none of the switches are depressed, and therefore it is possible to select up to fifteen sheet sizes.

In connection with this, the size detection sensor 50 is not necessarily used for detecting "the state that the cassette is drawn out". The size detection sensor 50 may be used only for sheet size detection, in which case it is possible to select up to sixteen sheet sizes.

Figure 3:
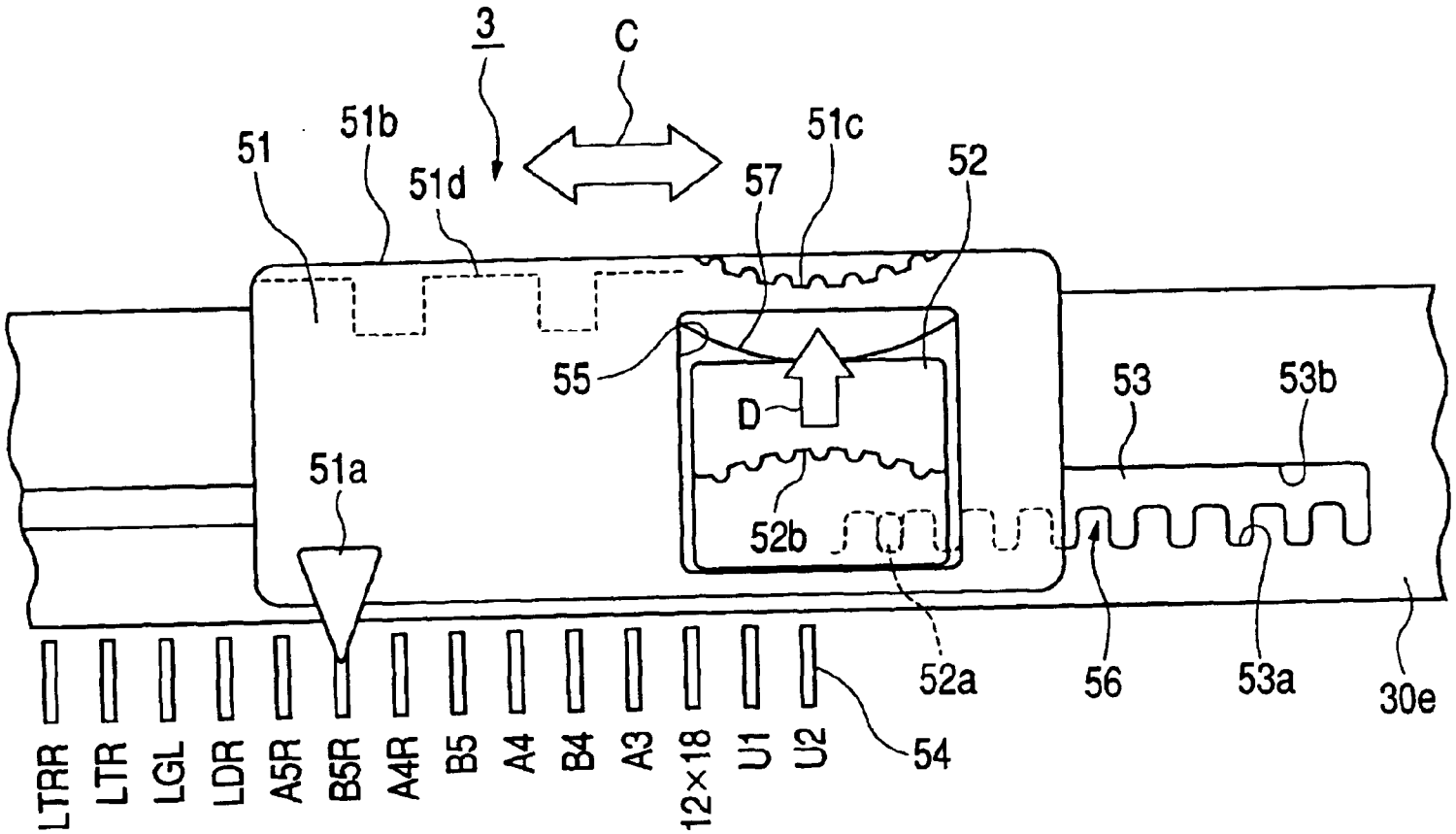
FIG. 3 is a plan view showing a sheet size selector and a locking mechanism.

As shown in FIG. 3, an unlock lever 52 is movably provided in a recessed portion 55 of the sheet size selector 51. The unlock lever 52 is provided with a projection 52*a* that downwardly projects from the unlock lever 52 and extends through the recessed portion 55 to get into a lock groove 53. The unlock lever 52 is biased against the sheet size scale 54 by a leaf spring 57. Other elastic members such as a rubber member or a coil spring may be used instead of the leaf spring 57. As shown in FIG. 4A, the unlock lever 52 is biased by the leaf spring 57, so that the projection 52 engages with one of size selection recesses 53*a* that are formed along the lock groove 53. Thus, the sheet size selector 51 is locked and fixed so as not to move in the direction indicated by the arrow C in FIG. 3.

When the user holds or pinches a holding portion 51*c* of the sheet size selector 51 and a holding portion 52*b* of the unlock lever 52 with fingers and pushes the unlock lever 52 in the direction indicated by the arrow D against the elastic force of the leaf spring 57, the projection 52*a* of the lever 52 is disengaged from the size selection recess 53*a* to get into a clearance groove 53*b*. Thus, the sheet size selector 51 is unlocked, so that the sheet size selector 51 can be moved to a position corresponding to the sheet size.

The lock groove 53 is includes an engaged portion in the form of, for example, the plurality of size selection recesses 53*a*, the clearance groove 53*b* in communication with the size selection recesses 53*a* and a sliding portion 53*c*. The lock groove 53, a pressed member in the form of, for example, the unlock lever 52 having a projecting portion in the form of, for example, the projection 52*a* and the leaf spring 57 constitute locking means in the form of, for example, a locking mechanism 56.

While the number of the size selection recesses 53*a* is as many as the number of types of the sheet sizes, the number itself is not determinate.

The positional relationship between the projection and the lock groove may be reversed. In other words, the structure may be modified in such a way that a lock groove is formed on the unlock lever 52, a projection is formed on the front edge portion 30*e* of the sheet feed tray 30, and the lock groove is to be moved toward and away from the projection so that the projection would engage with a size selection recess.

In the above-described structure, when the user moves the sheet size selector 51 to the position corresponding to the sheet size and then pushes the sheet feed tray 30 into the apparatus main body 1, the size detection sensor 50 of the sheet size detection apparatus 3 is operated by the sheet size selector 51. Thus, the sheet size detection apparatus 3 sends a size signal to the controller 40, so that the apparatus main body 1 can recognize the sheet size.

As has been described above, the sheet size selector 51 of the sheet size detection apparatus 3 according to the first embodiment is so constructed that the locking mechanism 56 is unlocked to allow position change only when the unlock lever 52 is pressed by the user. Therefore, in this sheet size detection apparatus 3, even if a stack of sheets or a user's hand touches the sheet size selector 51 upon placing the sheets on the sheet feed tray 30, the sheet size setting will not be changed inadvertently. In addition, the sheet size selector 51 is so constructed that it can be maintained in a state of indicating the selected sheet size for a long period of time.

Since the sheet size detection apparatus 3 does not suffer from the above-mentioned inadvertent or erroneous operation, it is possible to design the holding portion 51*c* of the sheet size selector 51 in such a way that it is positively projected to form a shape that is easy to be pinched by fingers together with the unlock lever 52 so that the sheet size selecting operation can be performed easily. In addition, the presence of the unlock lever 52 would remind the user of the fact that the sheet size selector 51 is a part to be operated and prevent the user from forgetting to change the size setting.

Furthermore, in the case that the sheet size selector 51 is displaced from a correct set position, the unlock lever 52 cannot be returned to the initial position, since the projection 52*a* is engaging with the sliding-portion 53*c* of the lock groove 53. By virtue of this, the sheet size detection apparatus 3 allows the user to readily recognize the fact that the locking mechanism is not returned to a locking state, visually. Thus, the user can perform locking operation again to set the sheet size selector 51 to the correct position.

Still further, in the locking mechanism 56 of the sheet size detection apparatus 3 according to the present embodiment, in the case that the position of the sheet size selector 51 is displaced to some extent, the position of the sheet size selector 51 can be corrected automatically by means of the biasing force of the leaf spring 57 of the unlock lever 52 and the relative positional relationship between the projection 52*a* of the unlock lever 52 and the size selection recesses 53*a* of the lock groove 53.

Specifically, engaging guide surfaces in the form of, for example, arcuate surfaces 52*aa* and 53*aa* are formed at corners of the projection 52*a* and at entrance corners of the size selection recesses 53*a*. Thus, even if there is a little displacement in the relative positional relationship between the projection 52*a* and the size selection recess 53*a*, the unlock lever 52 is pressed by the leaf spring 57, so that the projection 52*a* can get into the size selection recess 53*a* while guided by the arcuate surfaces 52*aa* and 53*aa*. Consequently, the sheet size detection apparatus 3 can select and indicate the sheet size correctly.

The size selection recesses 53*a* may be formed in a ratchet shape or a serration shape like in the size selection recesses 61*a* shown in FIGS. 8A and 8B that will be described later, and the projection 52*a* may be formed in a wedge shape or a triangle shape that engages with the ratchet part. In that case also, even if there is a little displacement in the relative positional relationship between the projection 52*a* and the size selection recess 53*a*, the projection 52*a* can get into the size selection recess 53*a* while guided by the oblique surface of the serration by virtue that the unlock lever 52 is pressed by the leaf spring 57.

Since the size detection sensor 50 is provided on the apparatus main body 1, there is no risk that the user can touch the size detection sensor 50 to cause malfunction or breakage of it.

Since the sheet size selector 51 is provided with the size pointer 51*a*, it is easy to set the sheet size selector 51 to the position of the selected sheet size.

While in this embodiment, the switching between the locked state and the unlocked state is performed by a lever, the present invention is not limited to this particular feature. The structure may be so modified that unlocking is performed by depressing a button, or a switching mechanism in which two positions corresponding to locking and unlocking can be selected may be adopted.

In this embodiment, the present invention is applied to a sheet size selector that causes a size detection sensor to read the size. However, it is apparent that as a subordinate concept, the present invention can also be applied to a size indicator for informing users of the size of the sheets accommodated in a sheet feed tray.

Sheet Size Detection Apparatus According to Second Embodiment

A sheet size detection apparatus according to the second embodiment will be described with reference to FIGS. 6, 7, 8A and 8B.

Figure 6:
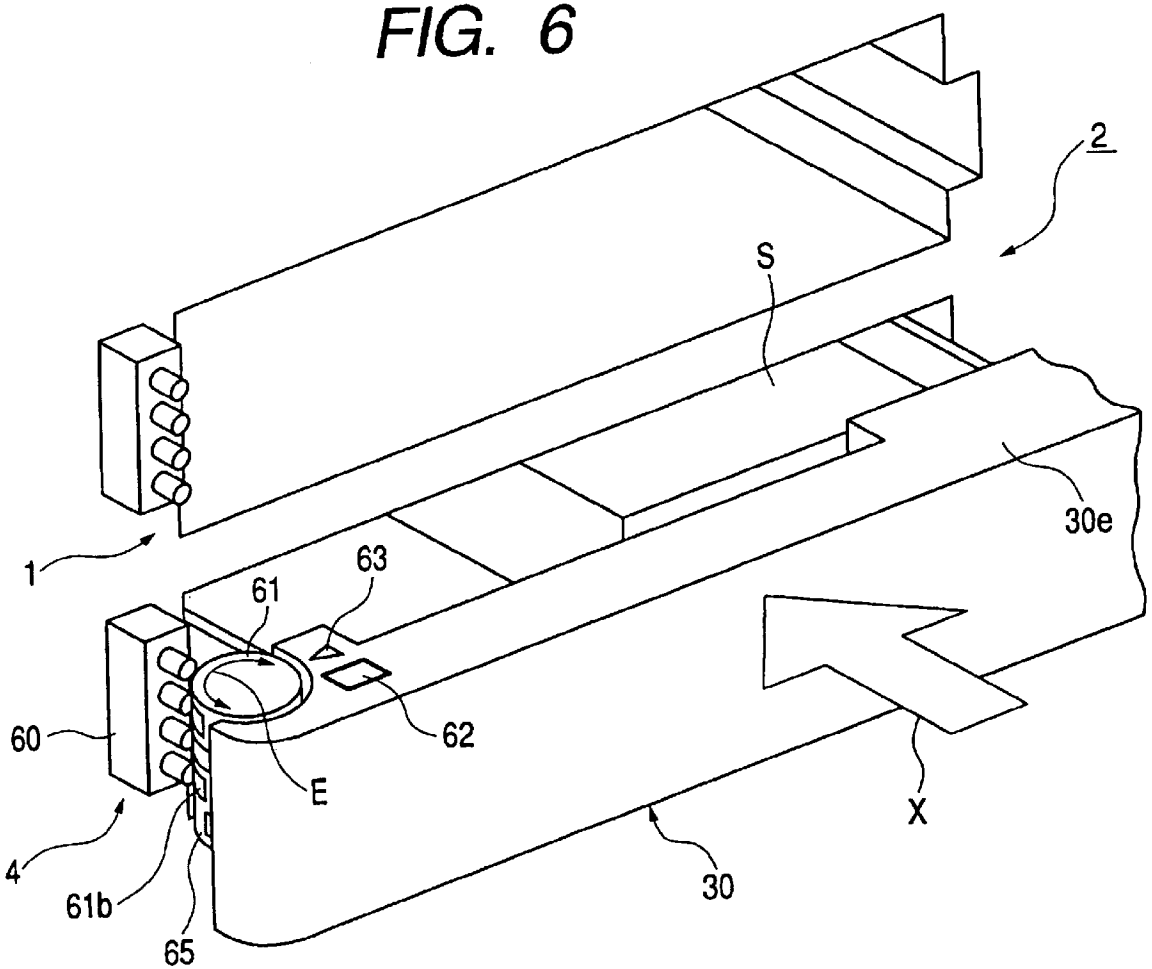
FIG. 6 is a partial perspective view showing a sheet size detection apparatus according to a second embodiment of the present invention.

FIG. 6 is a perspective view showing a sheet feed tray 30 provided with the sheet size detection apparatus 4 using a rotary sheet size selection member 61 according to the second embodiment. The sheet feed tray 30 is illustrated in the state in which the sheet feed tray 30 is drawn out from the apparatus main body 1. The parts same as those in the first embodiment will be designated by the same reference signs, and descriptions thereof will be omitted.

Figure 7:
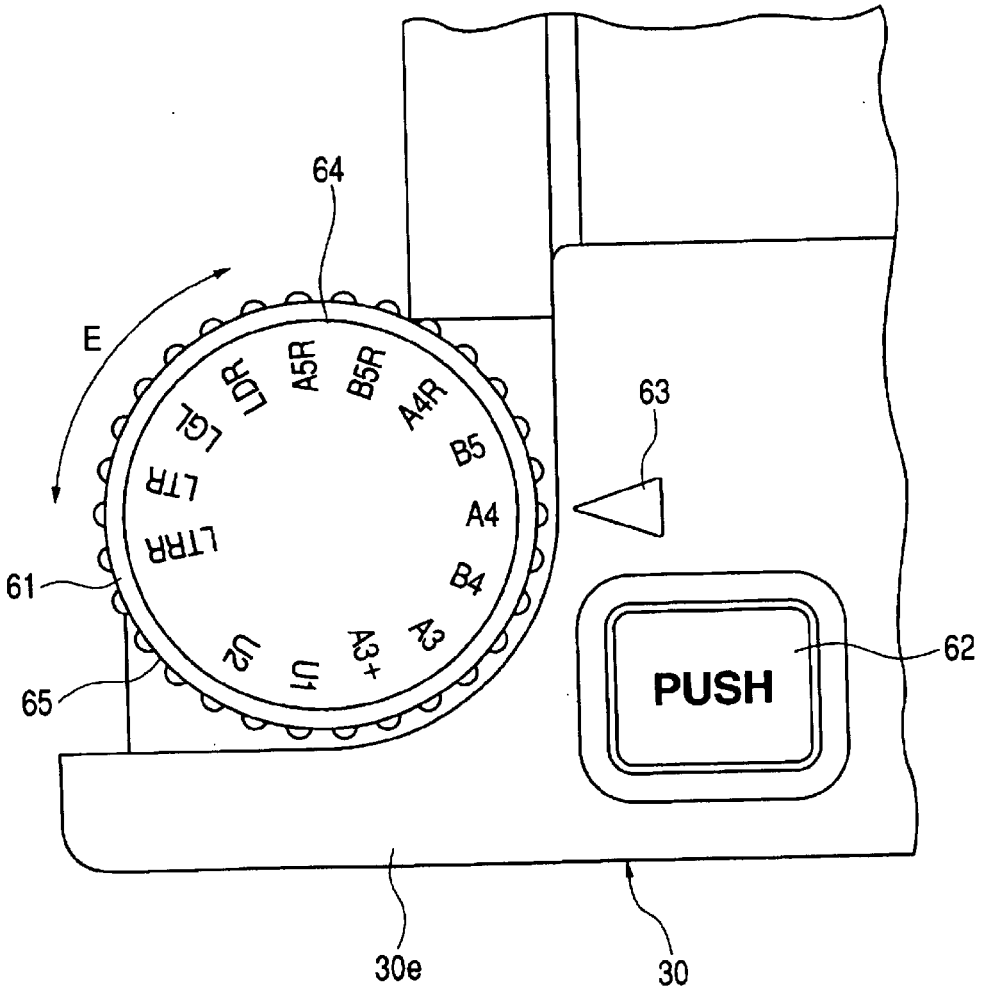
FIG. 7 is a plan view showing a sheet size selector.

On the front edge portion 30*e* of the sheet feed tray 30, there is provided a sheet size selection member in the form of, for example, a sheet size selector 61. The sheet size selector 61 is rotatably provided on the front edge portion 30*e* in such a way that its shaft 76 is supported by a cylindrical support shaft 69 (see FIGS. 8A and 8B) projecting from the front edge portion 30*e*. The sheet size selector 61 is rotatable in the direction indicated by the arrow E. The sheet size detection apparatus 4 according to this embodiment is constructed, as shown in FIG. 7, in such a way that setting of the sheet size is performed by a user by adjusting a sheet size scale 64 printed on the top surface of a selection drum 65 to an indicator in the form of, for example, a size pointer 63 provided on the sheet feed tray 30. In connection with this, a click mechanism is provided between the sheet size selector 61 and the sheet feed tray 30. The click mechanism is for enabling the user to confirm, by a click feeling, that the sheet size selector 61 has moved to a correct set position during the rotational movement of the sheet size selector 61. This mechanism itself is not shown in the drawing, since it is not a major feature of this embodiment.

On the other hand, a size detection sensor 60 comprising four juxtaposed switches is disposed at a position to be opposed to the sheet size selector 61 when the sheet feed tray 30 is attached to the apparatus main body 1 of the printer 2 and pushed in the direction indicated by the arrow X in FIG. 6. On the cylinder side surface 61*b* of the sheet size selector 61 that is to be opposed to a size detection sensor 60, a detected portion engraved with a predetermined pattern including projections and depressions is formed. The position of the projections and depressions relative to the sheet size detection means in the form of, for example, the size detection sensor 60 varies depending on the rotational position of the sheet size selector 61. Thus, the relationship between the position of the projections and depressions and the four juxtaposed switches of the size detection sensor 60 varies, so that switches to be operated change. The size detection sensor 60 according to this embodiment is also used for detecting "the state that the cassette is drawn out" by the state in which none of the switches are depressed, and therefore it is possible to select, for example, up to fifteen sheet sizes. In connection with this, the size detection sensor 60 is not necessarily used for detecting "the state that the cassette is drawn out". In other words, the size detection sensor 60 may be used only for sheet size detection.

Beside the sheet size selector 61, there is provided an unlock button for releasing or unlocking locking means in the form of, for example, a locking mechanism 67. When the unlock button 62 is depressed by the user, the sheet size selector 61 is brought into a freely rotatable state.

The locking mechanism 67 will be described with reference to FIGS. 8A and 8B. The sheet size selector 61 has an engaged portion in the form of, for example, ratchet-like multiple size selection recesses 61*a* formed on the bottom of the cylinder sidewall. At the tip end of a reverse L-shape link 68 that is integral with the unlock button 62, there is provided a projecting portion in the form of, for example, a stopper 62*a* for engagement with the size selection recesses 61*a* to regulate the rotation of the sheet size selector. The stopper 62*a* is formed in a triangle shape so that it would engage with one of the size selection recess 61*a*. The unlock button 62 is so biased by a spring 66 that the stopper portion 62*a* is in pressure contact with the size selection recess 61*a* of the sheet size selector 61.

While the spring 66 is a coil spring, the spring is not limited to a coil spring and an elastic member such as a leaf spring or a rubber member may also be used. While the number of the size selection recesses 61*a* is as many as the number of types of the sheet sizes, the number itself is not determinate.

Figure 8A:
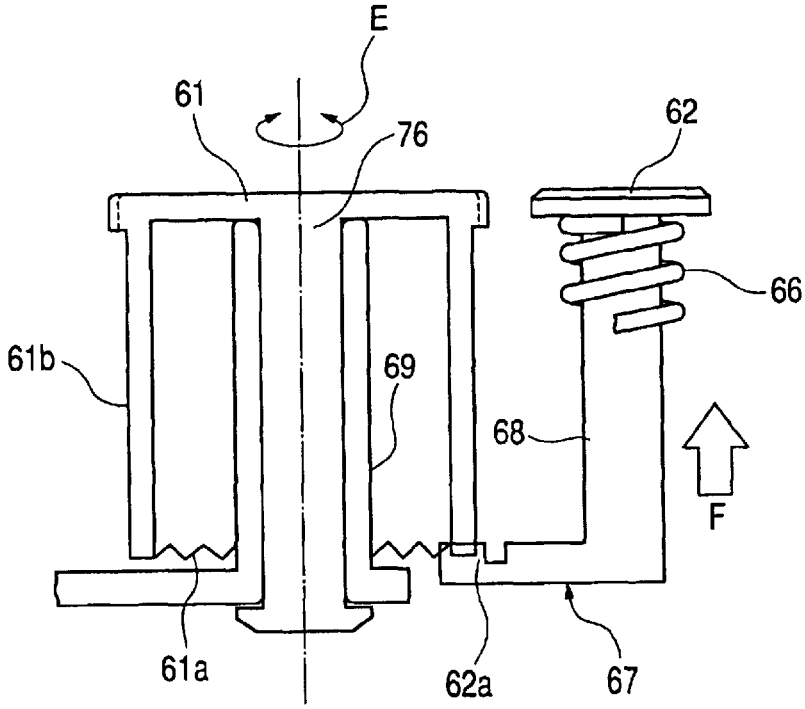
FIG. 8A is a drawing showing a locking mechanism of the sheet size detection apparatus shown in FIG. 6 in the state in which it regulates the rotation of the sheet size selector (i.e. the state for prohibiting rotation).
Figure 8B:
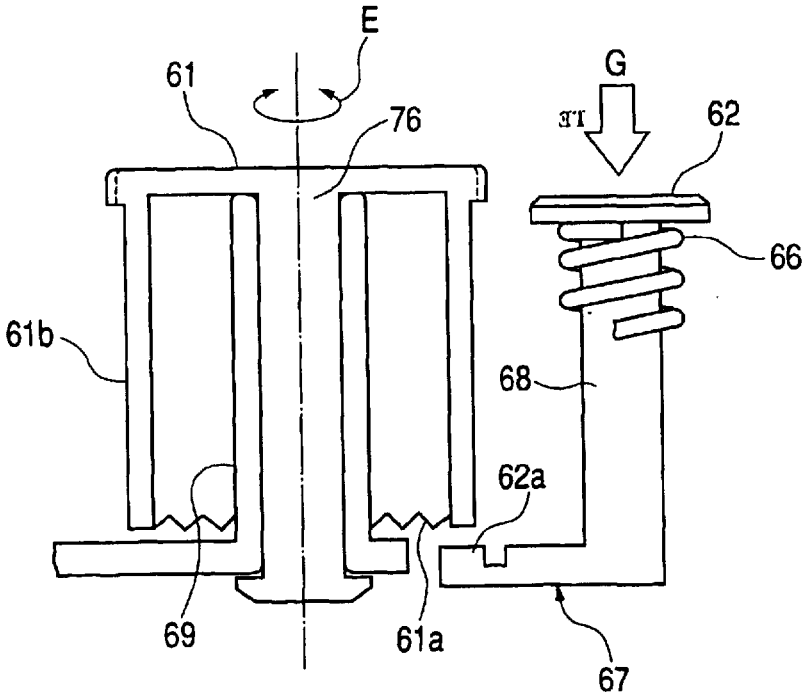
FIG. 8B is a drawing showing a locking mechanism of the sheet size detection apparatus shown in FIG. 6 in the state in which the regulation of the rotation of the sheet size selector is released (i.e. the state for allowing rotation).

Normally, the sheet size selector 61 is unable to rotate, since, as shown in FIG. 8A, the unlock button 62 is pressed by the spring 66 upwardly in the direction indicated by the arrow F and the stopper portion 62*a* engages with one of the size selection recess 61*a* to regulate the rotation of the sheet size selector 61. However, as shown in FIG. 8B, when the user depresses the unlock button 62 in the direction indicated by the arrow G against the spring 66, the stopper portion 62*a* is detached from the size selection recess 61*a* to release the lock state, so that the sheet size selector 61 becomes freely rotatable. As a result, in the sheet size detection apparatus, it is possible to adjust the sheet size scale 64 with the size pointer 63 to attain sheet size selection indication.

In the above-described structure, when the user rotates the sheet size selector 61 to the position corresponding to the sheet size and then pushes the sheet feed tray 30 into the apparatus main body 1, the size detection sensor 60 of the sheet size detection apparatus 4 is operated by the sheet size selector 61. Thus, the sheet size detection apparatus 4 sends a size signal to the controller 40, so that the apparatus main body 1 can recognize the sheet size.

As has been described above, the sheet size selector 61 of the sheet size detection apparatus 4 according to the second embodiment is so constructed that the locking mechanism 67 is unlocked to allow position change only when the unlock button 62 is depressed by the user. Therefore, in this sheet size detection apparatus 4 according to the second embodiment also, even if a stack of sheets or a user's hand touches the sheet size selector 61 upon placing the sheets on the sheet feed tray 30, the sheet size setting will not be changed inadvertently. In addition, the sheet size selector 61 is so constructed that it can be maintained in a state of indicating the selected sheet size for a long period of time.

Furthermore, in the locking mechanism 67 of the sheet size detection apparatus 4, even in the case that the position of the sheet size selector 61 is displaced to some extent, the position of the sheet size selector 61 can be corrected automatically by means of the biasing force of the spring 66 of the unlock button 62 and the engagement of the triangular shape of the projecting portion in the form of, for example, the stopper 62*a* of the unlock button 62 and the triangular recessed shape of the size selection recess 61*a*.

Figure 4B:
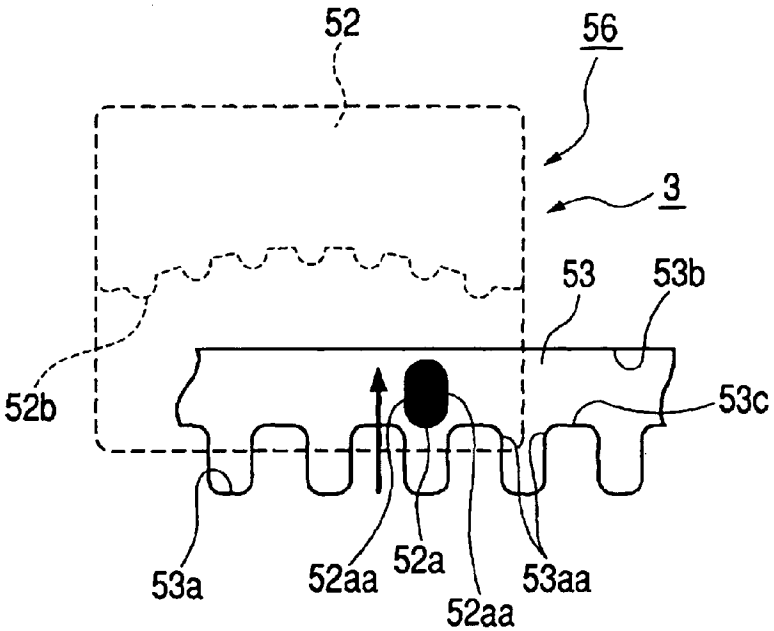
FIG. 4B is a drawing showing the locking mechanism in its unlock state (i.e. the state for allowing movement).
Figure 4A:
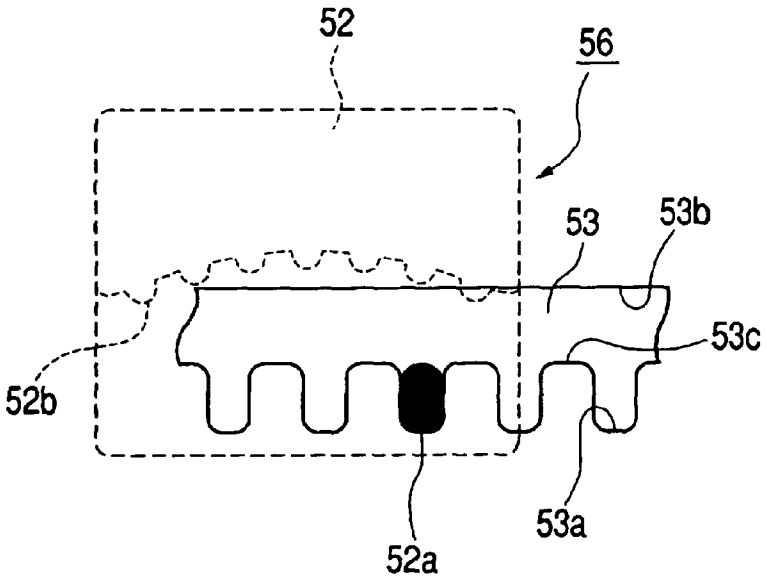
FIG. 4A is a drawing showing the locking mechanism in its lock state (i.e. the state for prohibiting movement).
Figure 5:
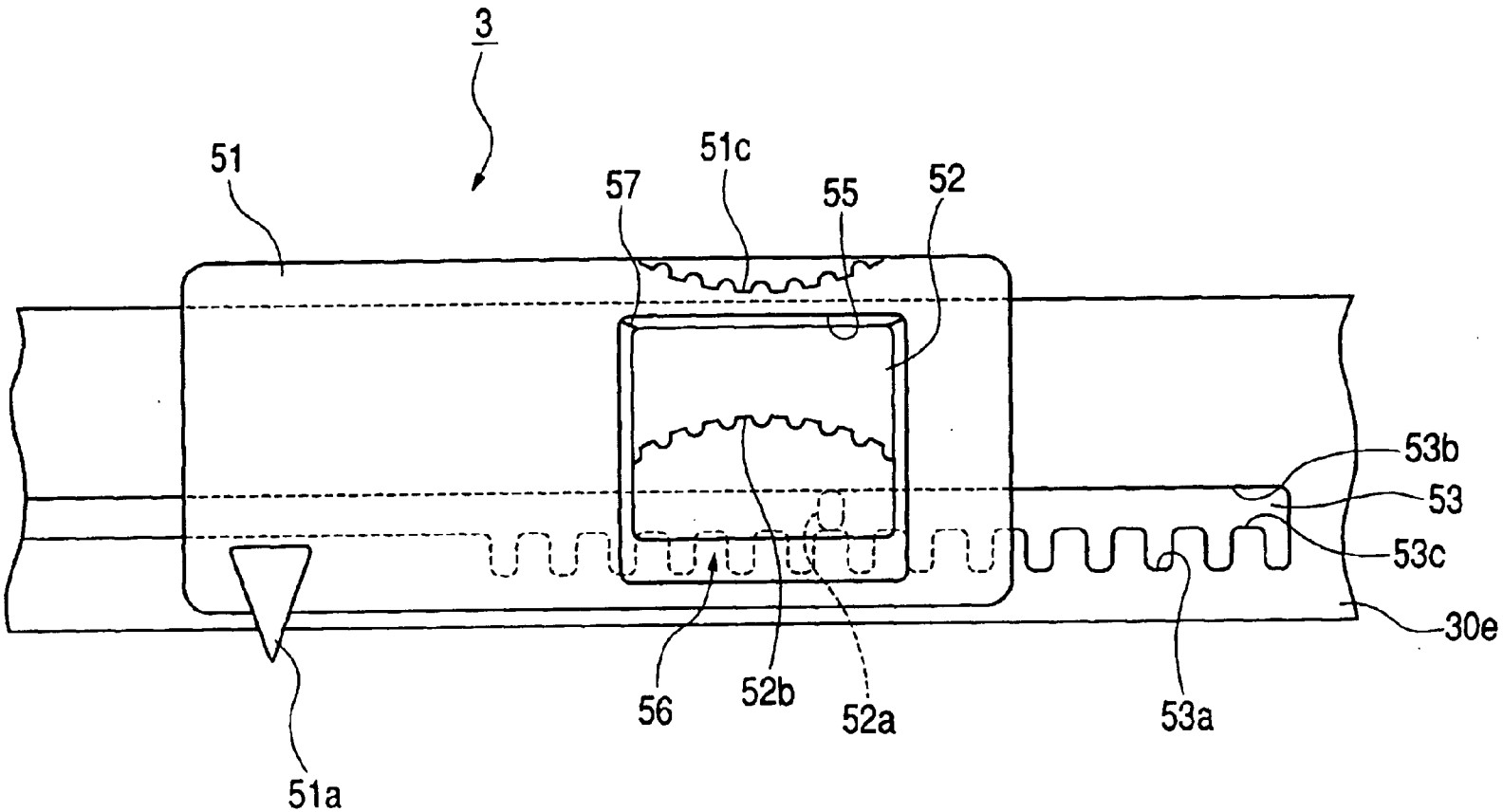
FIG. 5 is a drawing showing the locking mechanism in a state in which it is accidentally operated.

The size selection recesses 61*a* may be formed in rectangular shapes and the projection 62*a* may be formed as a rectangular projection in a manner similar to those shown in FIGS. 3, 4A and 4B. In that case, if the stopper 62*a* is displaced from the correct set position, the stopper 62*a* of the unlock button 62 cannot get into a size selection recess 61*a*. By virtue of this, the size selection recesses 61*a* of this embodiment allows the user to readily recognize the fact that the locking mechanism is not returned to a locking state, visually. Thus, the user can perform locking operation again to set the sheet size selector 61 to the correct position.

Furthermore, since the size detection sensor 60 is provided on the apparatus main body 1, there is no risk that the user can touch the size detection sensor 50 to cause malfunction or breakage of it.

While the switching between the locked state and the unlocked state is performed by a button in this embodiment, the present invention is not limited to this particular feature. The structure may be so modified that unlocking is performed by pressing a lever, or a switching mechanism in which two positions corresponding to locking and unlocking can be selected may be adopted.

Sheet Size Detection Apparatus According to Third Embodiment

In the sheet size detection apparatus according to the first and second embodiments, the sheet size selector is provided on the front edge portion of a sheet feed tray and the sheet size selector and the size detection sensor are arranged to be opposed to each other in the drawing-out/inserting (or loading/unloading) direction of the sheet feed tray. However the sheet size detection apparatus according to the present invention is not limited to such a disposition and structure. The sheet size selector may be provided on a side portion of a sheet feed tray, and the sheet size selector and the size detection sensor may be arranged to be opposed to each other in the direction transverse to the drawing-out/inserting direction of the sheet feed tray. A sheet size detection apparatus having such a structure will be described as the third embodiment.

The sheet size detection apparatus 5 according to the third embodiment will be described with reference to FIGS. 9, 10, 11A and 11B. The basic structure of the sheet size detection apparatus 5 according to the third embodiment is the same as the sheet size detection apparatus 3 according to the firs embodiment.

Figure 9:
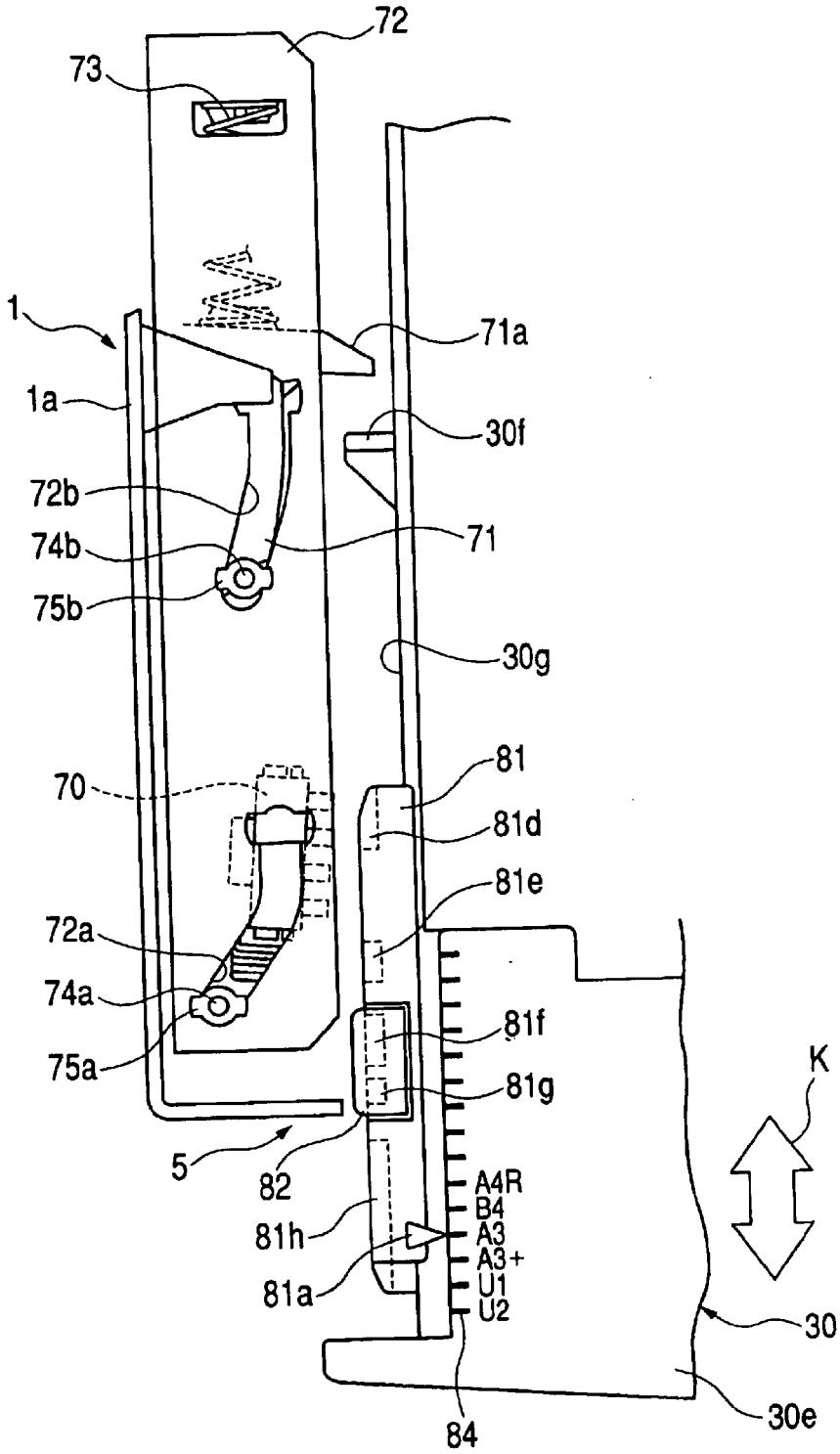
FIG. 9 is a plan view showing a sheet size detection apparatus according to a third embodiment of the present invention.
Figure 10:
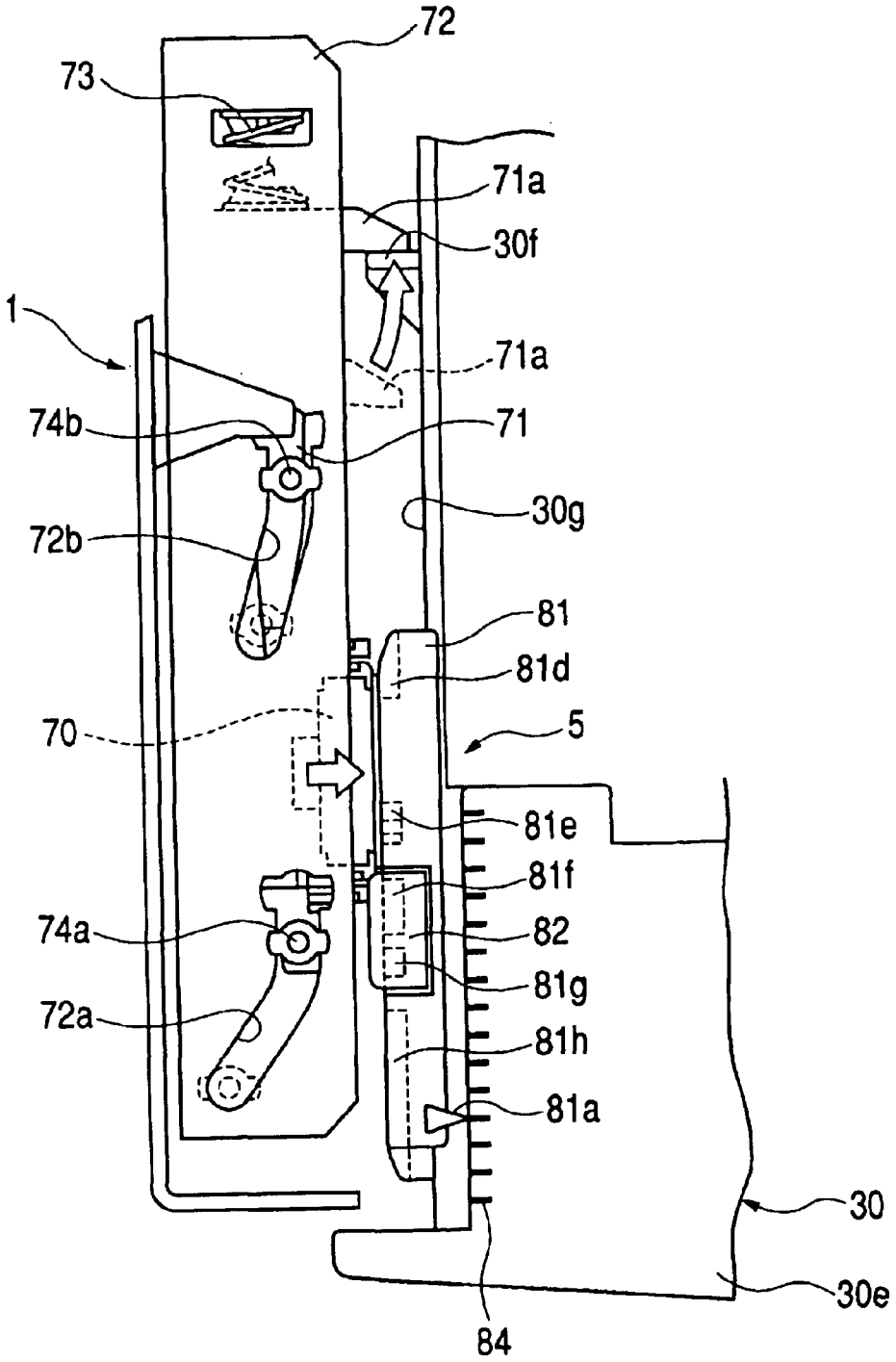
FIG. 10 is a plan view showing the sheet size detection apparatus shown in FIG. 9 in the state in which a sheet feed tray has been pushed into an apparatus main body.
Figure 11A:
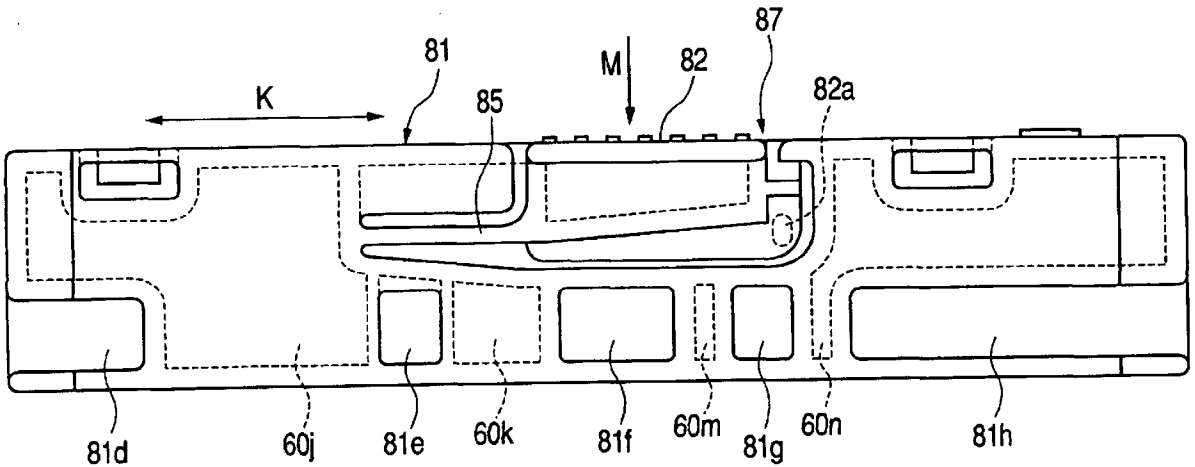
FIG. 11A is a side view of a sheet size selector of the sheet size detection apparatus shown in FIG. 9.
Figure 11B:
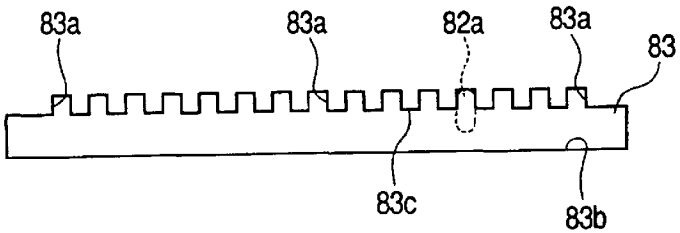
FIG. 11B is a drawing showing a lock groove of a locking mechanism of the sheet size detection apparatus shown in FIG. 9.
Figure 12:
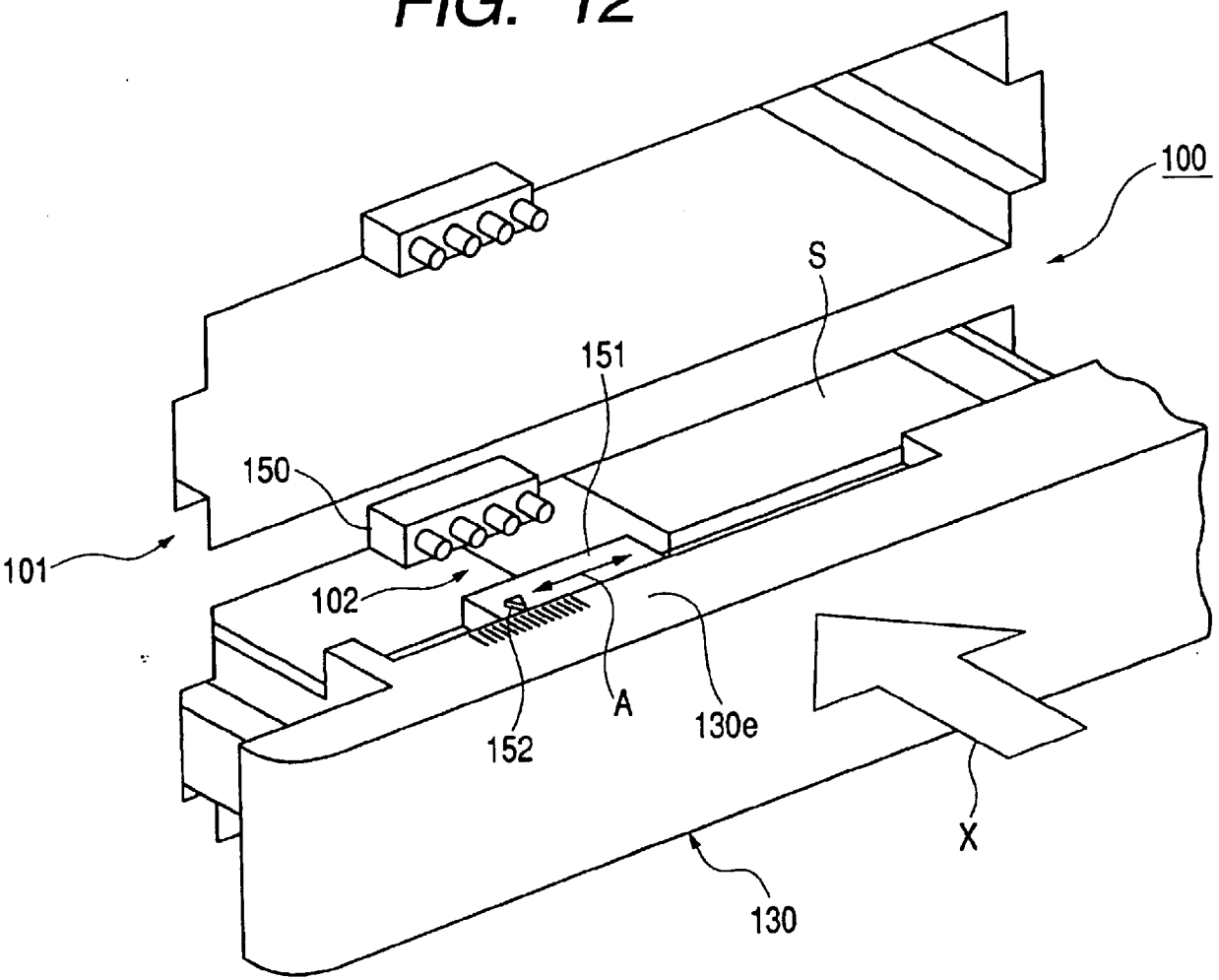
FIG. 12 is a perspective view showing a sheet feed tray, in a conventional image forming apparatus, provided with a conventional sheet size detection apparatus using a slide type sheet size selection member.
Figure 13:
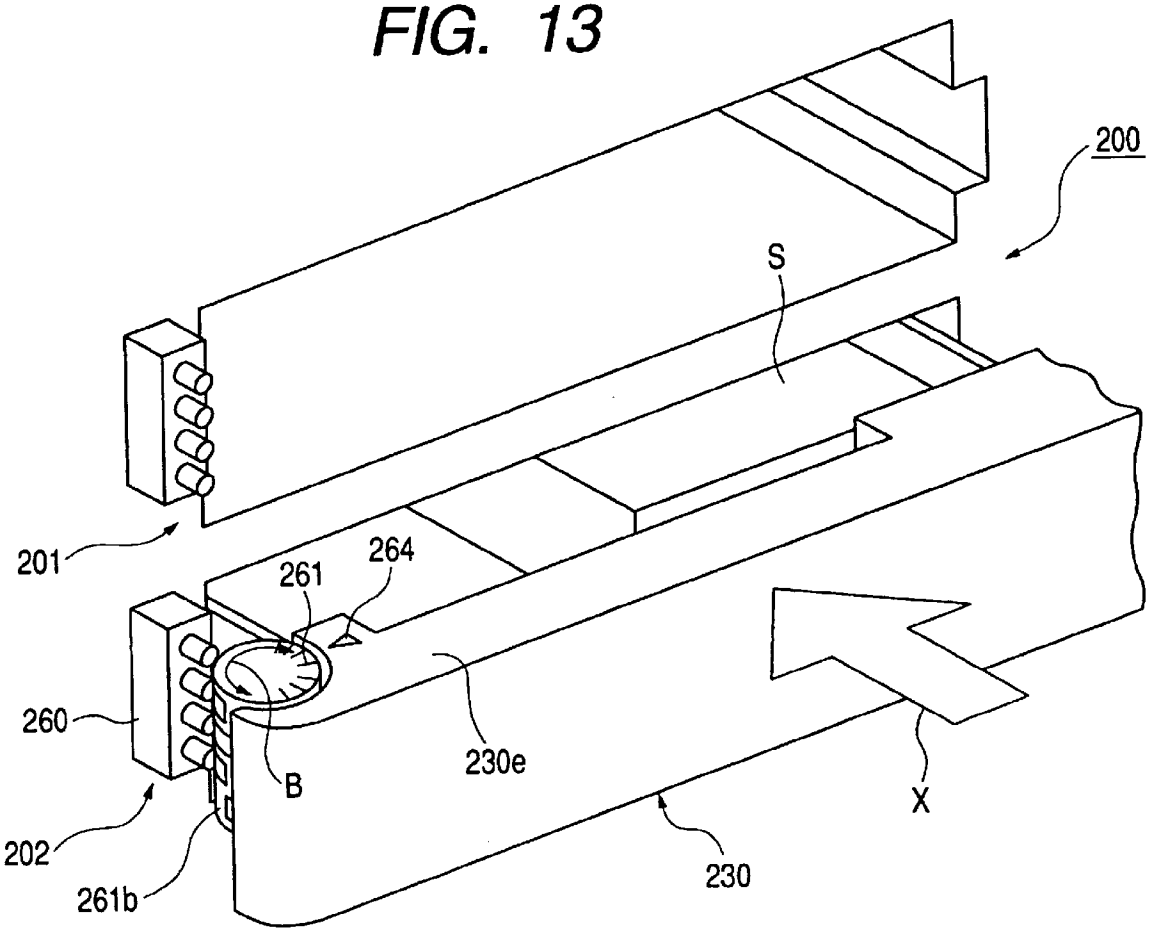
FIG. 13 is a perspective view showing a sheet feed tray, in a conventional image forming apparatus, provided with a conventional sheet size detection apparatus using a rotary type sheet size selection member.

FIG. 9 is a plan view showing the sheet size detection apparatus 5 in a state in which a sheet feed tray 30 is drawn out from the apparatus main body 1. FIG. 10 is a plan view showing the sheet size detection apparatus 5 in a state in which the sheet feed tray 30 is loaded into the apparatus main body 1. FIGS. 11A and 11B are drawings showing a portion related to a sheet size selector of the sheet size detection apparatus 5 as seen from the left side.

A sheet size selection member in the form of, for example, a sheet size selector 81 is provided on a side surface 30*g* of the sheet feed tray 30 in such as way as to be slidable along the loading and unloading direction of the sheet feed tray 30 (i.e. the direction indicated by the arrow K). The sheet size selector 81 is constructed in such away as to be locked at a plurality of positions selectively by locking means in the form of, for example, a locking mechanism 87 that will be described later. The sheet size selector 81 is provided with a size pointer 81*a* for indicating a sheet size scale 84 formed on the sheet feed tray 30.

With the above-described structure, the position of the sheet size selector 81 cannot be changed unless the user presses an unlock lever 82 of the locking mechanism 87. When the user presses the unlock lever 82, the locking mechanism 87 is unlocked and the sheet size selector 81 becomes freely movable, so that the size pointer 81*a* can be adjusted to the position on the sheet size scale 84 that corresponds to the size of the sheets accommodated in the sheet feed tray 30.

On the other hand, on the side portion 1*a* of the apparatus main body 1, there is provided a sensor box 72. A sensor slider 71 having pins 74*a* and 74*b* is slidably provided on the apparatus main body 1. The sensor slider is slidable while guided by the pins 74*a* and 74*b* and slide grooves 72*a* and 72*b* formed on the sensor box 72. Sheet size detection means in the form of, for example, a size detection sensor 70 adapted to abut the sheet size selector 81 to detect the size setting is provided on the sensor slider 71. The sensor slider 71 is retained in the slide grooves 72*a* and 72*b* by means of collars 75*a* and 75*b* provided on the pins 74*a* and 74*b*, so that it is not detached from the sensor box 72.

The sensor slider 71 is biased in the drawing-out direction of the sheet feed tray 30 by an elastic force of a compression spring 73. Consequently, in the state in which the sheet feed tray 30 is drawn out from the apparatus main body 1, the size detection sensor 70 is retreated and spaced apart from the sheet size selector 81. However, when the sheet feed tray 30 is pushed into the apparatus main body 1 as shown in FIG. 10, a projecting portion 30*f* of the sheet feed tray 30 engages with a projection 71*a* of the sensor slider 71, and the sensor slider 71 is pushed in the loading direction of the sheet feed tray 30. Consequently, the sensor slider 71 slides along the slide grooves 72*a* and 72*b* to move to a position at which the size detection sensor 70 is in contact with the sheet size selector 81. Thus, the sheet size detection apparatus 5 can detect the sheet size and inform the apparatus main body 1 of the sheet size.

The size detection sensor 70 is composed of four juxtaposed switches, which are arranged in such a way that switches to be operated would change in accordance with the relative positional relationship between the switches and a pattern including a plurality of recessed portions formed on the sheet size selector 8 that will be described later. The size detection sensor 70 according to this embodiment is also used for detecting "the state that the cassette is drawn out" by the state in which none of the switches are depressed, and therefore it is possible to select, for example, up to fifteen sheet sizes. In connection with this, the size detection sensor 70 is not necessarily used for detecting "the state that the cassette is drawn out". The size detection sensor 70 may be used only for sheet size detection.

The locking mechanism 87 will be described with reference to FIGS. 11A and 11B. The unlocking lever 82 is integrally formed on the sheet size selector 81 via an elastic support piece 85. Alternatively, the unlocking lever 82 may be rotatably provided on the sheet size selector while supported by an elastic member in a manner similar to the state shown in FIG. 11A.

The positional relationship between the projection and the lock groove may be reversed. In other words, the structure may be modified in such a way that a lock groove is formed on the unlock lever 82, a projection is formed on the side portion 30*g* of the sheet feed tray 30, and the lock groove is to be moved toward and away from the projection so that the projection would engage with size selection recesses.

On the surface of the unlock lever 82 that faces the sheet feed tray 30, there is provided a projecting portion in the form of, for example, a projection 82*a*. On the side surface of the sheet feed tray 30 that faces the projection 82*a*, there is provided a lock groove 83 with which the projection 82 engages. The lock groove 83 is formed on the side surface of the sheet feed tray 30 on which the sheet size selector 81 is provided. The lock groove 83 is composed of an engaged portion in the form of, for example, a plurality of size selection recesses 83*a*, a clearance groove 83*b* in communication with the size selection recesses 83*a* and a sliding portion 83*c*.

On the portion of the unlock lever 82 that is opposed to the size detection sensor 70, there is arranged a detected portion in the form of recessed portions 81*d*, 81*e*, 81*f*, 81*g* and 81*f* having different lengths in the moving direction of the sheet size selector 81 (i.e. in the directions indicated by the double-headed arrow K). The recessed portions may be holes instead.

Normally, the projection 82*a* of the unlock lever 82 is engaging with one of the plurality of recessed portions 83*a* that are formed along the lock groove 83 while biased by the elastic support piece 85. Consequently, the sheet size selector 81 is locked and fixed so as not to move in the directions indicated by the double-headed arrow K. Thus, in the sheet size detection apparatus 5, even if a stack of sheets or a user's hand touches the sheet size selector 81 upon placing the sheets on the sheet feed tray 30, the sheet size setting will not be changed inadvertently. In addition, the sheet size selector 81 is so constructed that it can be maintained in a state of indicating the selected sheet size for a long period of time.

When the user pushes the unlock lever 82 of the sheet size selector 81 in the direction indicated by the arrow M against the elastic force of the elastic support piece 85, the projection 82*a* of the unlock lever 82 is disengaged from the size selection recess 83*a* to get into the clearance groove 83*b*. Thus, the sheet size selector 81 is unlocked, so that the sheet size selector 81 can be moved to a position corresponding to the sheet size.

Furthermore, in the case that the sheet size selector 81 is displaced from a correct set position, the unlock lever 82 cannot be returned to the initial position since the projection 82*a* is engaging with the sliding portion 83*c* of the lock groove 53. By virtue of this, the sheet size detection apparatus 5 allows the user to readily recognize the fact that the locking mechanism 87 is not returned to a locking state, visually. Thus, the user can perform locking operation again to set the sheet size selector 81 to the correct position.

In addition, engaging guide surfaces in the form of, for example, arcuate surfaces may be formed at corners of the projection 82*a* and at entrance corners of the size selection recesses 83*a* in a manner similar to those shown in FIG. 4B so that even if there is a little displacement in the relative positional relationship between the projection 82*a* and the size selection recess 83*a*, the unlock lever 82 would be pressed by the elastic support piece 85 and the projection 82*a* can get into the size selection recess 83*a* while guided by the arcuate surfaces.

When the sheet size selector 81 is set to an appropriate position and the sheet feed tray 30 is loaded into the apparatus main body 1, the projecting portion 30*f* of the sheet feed tray 30 engages with the projection 71*a* of the sensor slider 71, so that the sensor slider 71 is pushed in the loading direction of the sheet feed tray 30 while sliding along the slide groove 72*a* and 72*b*, and that the size detection sensor 70 moves to the position at which it abuts the sheet size selector 81. At that time, the recessed portions 81*d*, 81*e*, 81*f*, 81*g* and 81*h* causes the four juxtaposed switches of the size detection sensor 70 to operate selectively, so that the size detection sensor 70 can detect the size of the sheets accommodated in the sheet feed tray 30 and inform the apparatus main body 1 of the sheet size.

While in the sheet size detection apparatus according to the first to third embodiments described in the foregoing, locking of the sheet size selector is released by a user's operation on a button or a lever, the unlocking mechanism is not limited to a button or a lever, but it may be interlocked with an other mechanism provided for a different function. For example, a sheet feed tray is generally provided with a sheet regulation member such as a side regulation plate for regulation of the accommodated sheets with respect to the width direction and a rear end regulation plate for regulating the position of the sheets in the feeding direction. Upon changing the size of the accommodated sheets, the positions of those sheet regulation members are to be changed. The sheet size detection apparatus may be constructed in such a way that when the fixation of a sheet regulation member is released for the position change, locking of the sheet size selector is released interlocked with some operation for releasing the fixation of the sheet regulation member (for example, when an erroneous operation prevention cover for concealing a sheet regulation member fixing portion is opened, locking of the sheet size selector is released by a link that is interlocked with that operation).

The sheet size detection apparatus according to the present invention is not limited to the structure that requires a user's intentional unlocking operation. An alternative sheet size detection apparatus may be constructed in such a way that upon drawing out a sheet feed tray for sheet supply, the sheet feed tray can be drawn out by an additional stroke from a normal supply position while a click feeling is generated at the normal supply position, and locking of a sheet size selector is released only when the sheet feed tray is drawn to the maximum drawn out position, or that locking is release only at a specific halfway position in the drawn-out stroke of a sheet feed tray. Such structures can be easily realized by means of a mechanism that establishes interaction of a locking mechanism and a member of the printer using a link or the like.

With the printer 1 provided with the above-described sheet size detection apparatus that can prevent inadvertent operation mistakes upon sheet supply, enhance visibility and prevent malfunctions, the possibility of an operation mistake or a sheet jam is low, and so the printer can form images on sheets precisely and reliably.

The sheet size detection apparatus according to the present invention can regulate the movement of the sheet size selection member by means of locking means. Consequently, it is possible to avoid the operation mistake that a stack of sheets or a user's hand touches the sheet size selection member to change the size setting on the occasion of supplying sheet stacking means with sheets.

Since the sheet size detection apparatus according to the present invention is free from the above-mentioned operation mistake, it is possible to make the sheet size selection member to have a form easy to operate for users so as to enhance operability. In addition, it readily reminds the user of the fact that the sheet size selection member is "a part to be operated", so that it is possible to prevent the user from neglecting to perform the operation upon changing the sheets.

In the sheet size detection apparatus according to the present invention, the sheet size selection member is not locked in the case that it is not set in a correct position. Consequently, the user can readily recognize erroneous setting, so that the erroneous setting can be avoided.

What is claimed is:

1. A sheet size detection apparatus comprising:

sheet stacking means on which sheets are stacked and which can be loaded into and unloaded from a loading portion;

a sheet size selection member provided on said sheet stacking means, a position of said sheet size selection member being changeable in accordance with a size of stacked sheets;

sheet size detection means provided on the loading portion for detecting the sheet size based on a relative positional relationship with said sheet size selection member;

locking means for locking said sheet size selection member; and unlock means for releasing a locking operation of said locking means.

2. A sheet size detection apparatus according to claim 1, wherein said locking means has a projecting portion provided on one of said sheet stacking means and said sheet size selection member and a plurality of engaged portions, with which said projecting portion can engage, provided on the other of said sheet stacking means and said sheet size selection member, and wherein said projecting portion engages with said plurality of engaged portions to lock said sheet size selection member when said sheet size selection member is positioned in a position corresponding to a sheet size to be selected.

3. A sheet size detection apparatus according to claim 2, wherein said projecting portion is provided on a movable pressed member that is biased toward said plurality of engaged portions, wherein said projecting portion is adapted to be disengaged from said plurality of engaged portions when said pressed member is moved against a biasing force.

4. A sheet size detection apparatus according to claim 2, wherein each of said plurality of engaged portions has a recessed shape, and at corners of said projecting portion and said recessed shape opposed to each other, there are provided engagement guide surfaces for guiding each other.

5. A sheet size detection apparatus according to claim 1, wherein said sheet size selection member is provided on said sheet stacking means, and said sheet size detection means is provided on the loading portion to detect the sheet size based on a relative positional relationship with said sheet size selection member under a state in which said sheet stacking means is loaded into the loading portion.

6. A sheet size detection apparatus according to claim 1, wherein said sheet size selection member is provided on a side surface of said sheet stacking means, said sheet size detection means is provided on the loading portion in such a way as to be movable between a retreated position and a detection position, and said sheet size detection means is moved from said retreated position to said detection position in response to loading of said sheet stacking means to the loading portion.

7. A sheet size detection apparatus comprising:

a sheet feed tray detachably attachable to an apparatus main body and having an inner plate on which sheets are to be stacked;

a sheet size selector slidably provided on said sheet feed tray and to be set at a position corresponding to a size of the sheets by adjusting a size pointer to a sheet size scale on the apparatus main body;

a size detection sensor provided on the apparatus main body and having a plurality of switches that are to be turned on/off by a portion including projections and depressions provided on said sheet size selector when said sheet feed tray is attached to the apparatus main body;

a plurality of recessed portions formed on said sheet feed tray;

a projection formed on said sheet size selector and adapted to engage with any one of said plurality of recessed portions formed on said sheet feed tray; and an unlock lever including said projection formed on said sheet size selector and moving said projection away from said plurality of recessed portions formed on said sheet feed tray.

8. A sheet size detection apparatus according to claim 7, wherein said sheet size selector is slidably provided on a side surface of said sheet feed tray, said size detection sensor is movably supported by a slide groove formed on a sensor box provided on the apparatus main body, said slide groove guides a movement of said size detection sensor between a position spaced apart from said sheet feed tray and a position close to said sheet feed tray, and when said sheet feed tray is attached to the apparatus main body, said size detection sensor is pressed by said sheet feed tray to move along said slide groove from the position spaced apart from said sheet feed tray to the position close to said sheet feed tray, so that in the position close to the sheet feed tray, said plurality of switches of said size detection sensor are turned on/off by the portion including projections and depressions provided on said sheet size selector.

9. A sheet size detection apparatus according to claim 7, wherein said unlock lever is integrally formed on said sheet size selector by an elastic support piece having an elasticity, and said projection is integrally formed on said unlock lever.

10. An image forming apparatus comprising:

a sheet size detection apparatus as recited in any one of claims 1 to 8; and image forming means for forming an image on a sheet based on a sheet size detected by said sheet size detection apparatus.

* * * * *

UNITED STATES PATENT AND TRADEMARK OFFICE

CERTIFICATE OF CORRECTION

PATENT NO. : 6,826,383 B2
DATED : November 30, 2004
INVENTOR(S) : Takashi Yano

It is certified that error appears in the above-identified patent and that said Letters Patent is hereby corrected as shown below:

Column 11,
Line 61, “firs” should read -- first --.

Column 12,
Line 6, “as” should read -- a --.

Column 13,
Line 28, “81*f*” should read -- 81*h* --.

Column 14,
Line 25, “an other” should read -- another --.
Line 52, “release” should read -- released --.

Signed and Sealed this

Nineteenth Day of April, 2005

JON W. DUDAS
*Director of the United States Patent and Trademark Office*